US010519636B2

(12) United States Patent
Schlüter

(10) Patent No.: US 10,519,636 B2
(45) Date of Patent: Dec. 31, 2019

(54) FLOOR DRAIN HAVING A SEALING GASKET ATTACHED THERETO

(71) Applicant: Werner Schlüter, Iserlohn (DE)

(72) Inventor: Werner Schlüter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 12 days.

(21) Appl. No.: 15/766,284

(22) PCT Filed: Sep. 14, 2016

(86) PCT No.: PCT/EP2016/071701
§ 371 (c)(1),
(2) Date: Apr. 5, 2018

(87) PCT Pub. No.: WO2017/067717
PCT Pub. Date: Apr. 27, 2017

(65) Prior Publication Data

US 2018/0340319 A1 Nov. 29, 2018

(30) Foreign Application Priority Data

Oct. 23, 2015 (DE) ..... 20 2015 105 638 U

(51) Int. Cl.
*E03C 1/14* (2006.01)

(52) U.S. Cl.
CPC ..... *E03C 1/14* (2013.01)

(58) Field of Classification Search
CPC ..... E03C 1/14
USPC ..... 4/679
See application file for complete search history.

(56) References Cited

U.S. PATENT DOCUMENTS

2011/0047695 A1 3/2011 Niedens

FOREIGN PATENT DOCUMENTS

| | | | |
|---|---|---|---|
| DE | 3313898 | A1 | 10/1984 |
| DE | 102005036464 | B3 | 10/2006 |
| DE | 202009007350 | U1 | 5/2010 |
| DE | 202011051047 | U1 | 11/2012 |
| DE | 102011080284 | A1 | 2/2013 |
| EP | 2184415 | A1 | 5/2010 |
| EP | 2508685 | A1 | 10/2012 |
| EP | 2540923 | A2 | 7/2015 |

*Primary Examiner* — Lori L Baker
(74) *Attorney, Agent, or Firm* — Thorpe North & Western, LLP

(57) ABSTRACT

The invention relates to a floor drain (1) comprising an elongate housing (2), said housing having a base wall (3), two side walls (4, 5) extending in a longitudinal direction, two end walls (6, 7) connecting the side walls (4, 5) to one another, and a ceiling wall (8) provided with an elongate inlet opening (10) extending in the longitudinal direction (L), and further comprising an outflow connection piece (11) extending outwardly from the base wall (3) or one of the side walls (4, 5) or one of the end walls (6, 7) for the connection of a drain tube, wherein the inlet opening (10) ends in each case at a distance to the front-side ends of the ceiling wall (8) and at a distance to at least one of the side walls (4, 5), so that a receiving flange surrounding the inlet opening (10) is formed, on which a sealing gasket (14) is or can be attached.

15 Claims, 15 Drawing Sheets

FLOOR DRAIN HAVING A SEALING GASKET ATTACHED THERETO

Figure 1:
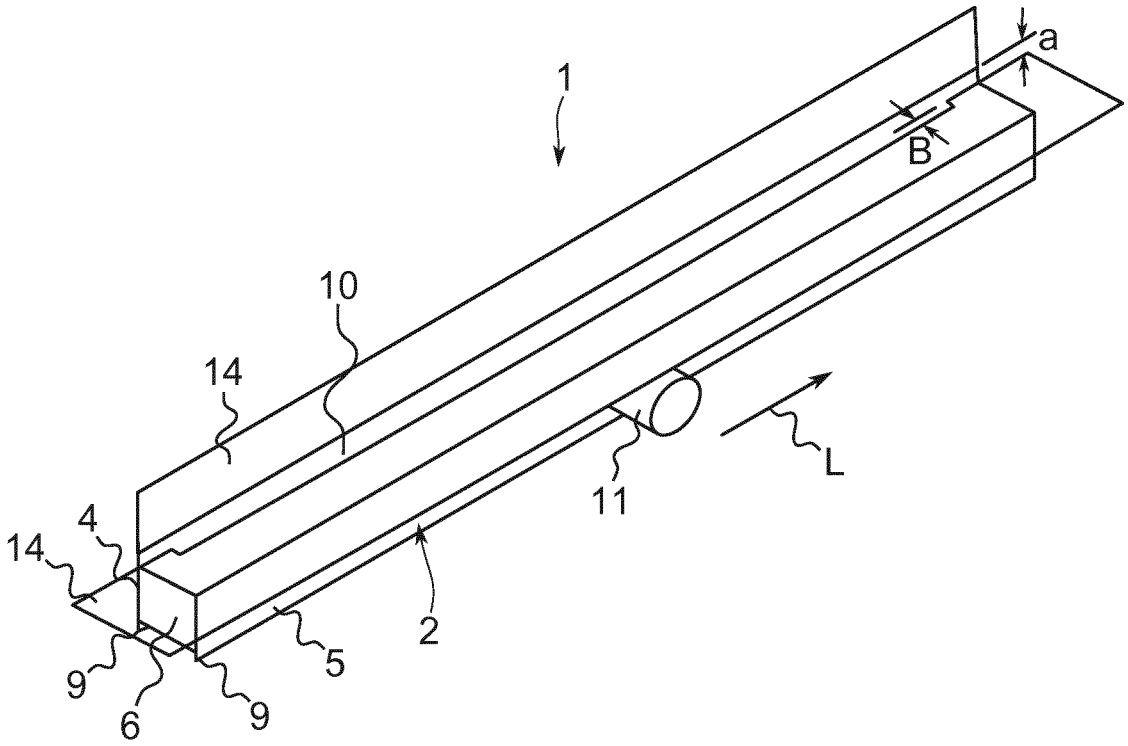

The present invention relates to a floor drain comprising an elongate housing which has a base wall, two side walls extending in a longitudinal direction, two end walls connecting the side walls to one another, and a ceiling wall provided with an elongate inlet opening extending in the longitudinal direction, and an outflow connection piece extending outwardly from the base wall or from one of the side walls or from one of the end walls for the connection of a drain tube.

Such floor drains are known in the prior art in a wide variety of embodiments and are used in particular in the installation of level-access showers. Thus, for example, WO 2007/014817 A1 describes a floor drain of the type specified at the start with an elongate housing which has an integrated odour trap with a helical cross-section, via which water, which is delivered to the housing via an inlet opening provided approximately centrally in the ceiling wall and extending in the longitudinal direction over the entire length of the ceiling wall, is discharged in the direction of an outflow connection piece disposed on one of the end walls. However, when installing the floor drain it has proven to be very difficult to establish a good seal between the ceiling wall and the surrounding substrate.

Proceeding from this prior art it is an object of the present invention to devise a floor drain of the type specified at the start with an alternative structure.

In order to achieve this object the present invention devises a floor drain of the type specified at the start which is characterised in that the inlet opening ends in each case a distance away from the front-side ends of the ceiling wall and a distance away from at least one of the side walls so that a receiving flange surrounding the inlet opening is formed to which a sealing gasket is or can be attached, for example using an appropriate adhesive. By virtue of this structure the sealing gasket can also be connected securely to the ceiling wall in the region between the inlet opening and the front-side ends of the ceiling wall so that during installation of the floor drain not only can a good seal be guaranteed at the side, but also a good front-side seal between the ceiling wall and the adjacent substrate.

According to one embodiment of the present invention the inlet opening is positioned a distance away from the front-side ends of the ceiling wall, which distance is at least 10 mm, in particular at least 20 mm. Therefore, sufficient space remains between the inlet opening and the front-side ends of the ceiling wall for the secure attachment of the sealing gasket.

Preferably, the sealing gasket is attached to the ceiling wall and projects at least a few centimetres over the front-side and/or side ends of the ceiling wall. Accordingly, a seal can easily be established.

Advantageously, the inlet opening has a width in the range of from 4 to 12 mm, as a result of which on the one hand good water outflow and on the other hand a visually attractive design is achieved.

Preferably, the ceiling wall defines at least one incline falling away in the direction of the inlet opening. Thus, the tiles, which are arranged in the correct state over the ceiling wall, are also provided with a correspondingly pre-defined incline.

Advantageously, the base wall and a lower region of the inner wall of the drain connection piece merge smoothly into one another. Correct outflow of the water is thus guaranteed.

Preferably, the base wall defines an incline falling away towards the outflow connection piece. This is also conducive to the correct discharge of water.

According to one embodiment of the present invention at least one supporting strut extending in the longitudinal direction extends between a side wall and the ceiling wall and/or between the base wall and the ceiling wall. Such a supporting strut increases the rigidity of the ceiling wall so that the latter can be loaded more strongly.

Preferably, the housing has feet which are designed in particular to extend the side walls and/or the front walls. By virtue of these feet the housing is raised somewhat so that an outflow pipe can be connected without any problem to the outflow connection piece.

According to one embodiment of the present invention the inlet opening borders directly on one of the side walls. This arrangement of the inlet opening has the advantage in comparison to centrally positioned inlet openings that when the floor drain according to the invention, during the installation of a level-access shower, is fitted directly to a shower wall, the inlet opening can be positioned directly adjacent to the shower wall, and so the sub-construction or the tiles only need to be provided with a single incline falling away in the direction of the inlet opening, and this only involves a small amount of effort. Another advantage is that the inlet opening is hardly perceivable in the fully installed show, and this results in a totally novel and attractive appearance.

Advantageously, a sealing gasket which projects upwards from the side wall is attached to the side wall bordering on the inlet opening. By virtue of one such sealing gasket a tight transition to an adjacent room wall is achieved if the corresponding side wall is positioned directly adjacent to the room wall.

Preferably, the side wall on which the inlet opening directly borders projects upwards over the ceiling wall, in particular by an amount between 10 and 20 mm. Therefore, the projecting region of the side wall defines a screen by means of which protection against splash water and a visually attractive appearance are achieved.

According to an alternative embodiment of the present invention the housing has at least one upwardly extending bar which is positioned adjacent to the inside of the side wall on which the inlet opening directly borders and extends from the base wall or the side wall, the side wall and the at least one bar defining between them a receiving slot, and an elongate, strip-shaped screen being provided which can be inserted into the receiving slot and the protrusion of which over the ceiling wall being able to be varied by the corresponding choice of insertion depth. This screen can be handled more flexibly than the previously described screen defined by the side wall.

Preferably, the at least one bar extends at least over the entire length of the inlet opening, in particular over the entire length of the housing, and this results in a simple structure.

Advantageously, the housing is made in one part or is made up of individual components connected to one another undetachably. This results in a very robust structure.

Preferably, an odour trap is formed within the housing which fluidically connects the inlet opening to the outflow connection piece so that no separate odour trap has to be provided.

According to one embodiment of the present invention the odour trap has at least two accumulation chambers which, in the correct state of the floor drain, fill with accumulated water, and an outflow chamber, the first accumulation chamber and the second accumulation chamber being separated from one another by a first partition wall extending in the longitudinal direction and downwards from the ceiling wall, which first partition wall is provided in the lower region with one or with a number of first through holes, and the second accumulation chamber and the outflow chamber being separated from one another by a second partition wall extending in the longitudinal direction and upwards from the base wall, which second partition wall is provided in the upper region with one or with a number of second through holes. By virtue of this structure a simple structure is achieved with a small amount of material usage.

Preferably, the accumulation chambers are closed on at least one of their front sides by an additional partition wall.

According to one embodiment of the present invention the inlet opening is positioned centrally and equidistantly from the side walls, the odour trap having a first accumulation chamber positioned centrally and two second accumulation chambers which are each positioned adjacent to the first accumulation chamber and are connected fluidically to a common outflow chamber.

Preferably, the height of the first and the second through holes is between 4 and 12 mm.

Advantageously, the odour trap and the housing are made in one part or are connected undetachably to one another, as a result of which a robust structure is achieved.

Figure 2:
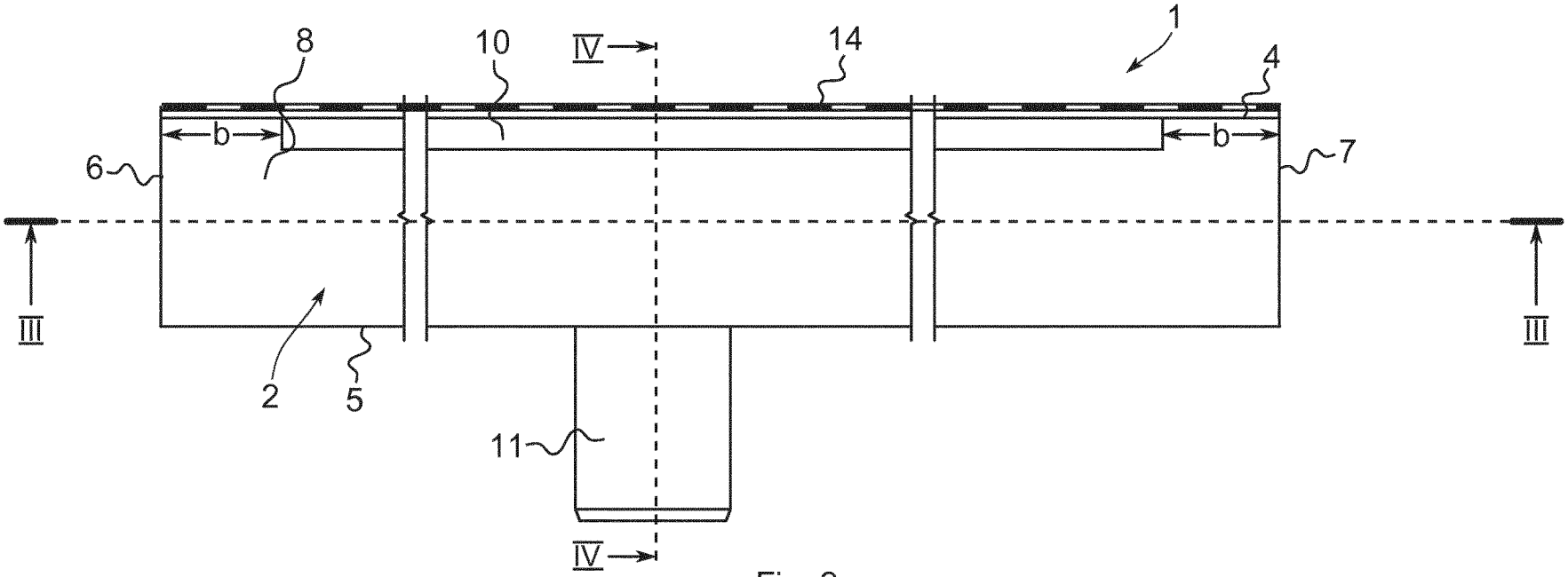
Figure 3:
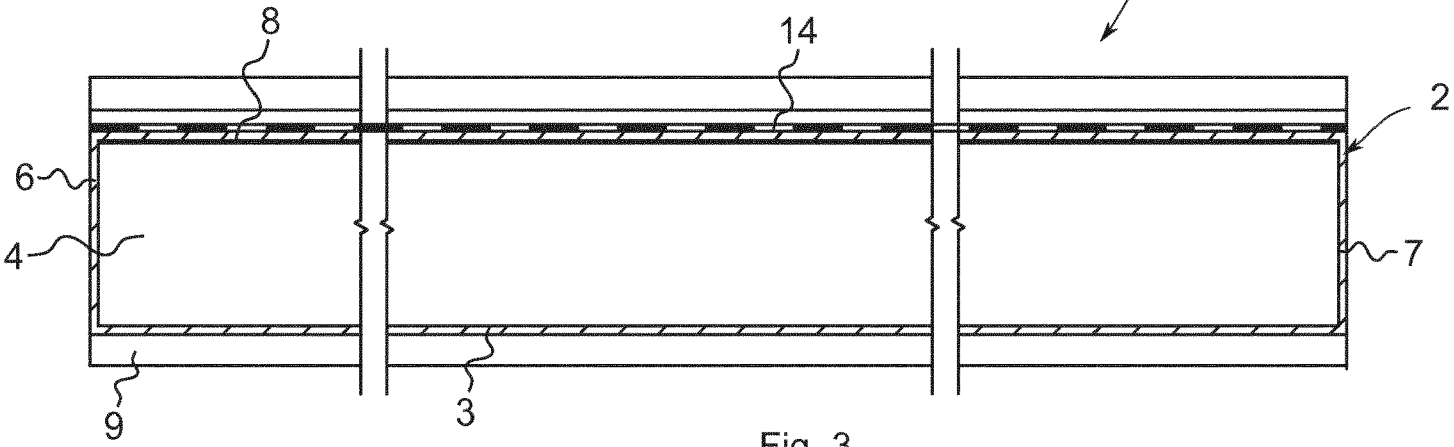
Figure 4:
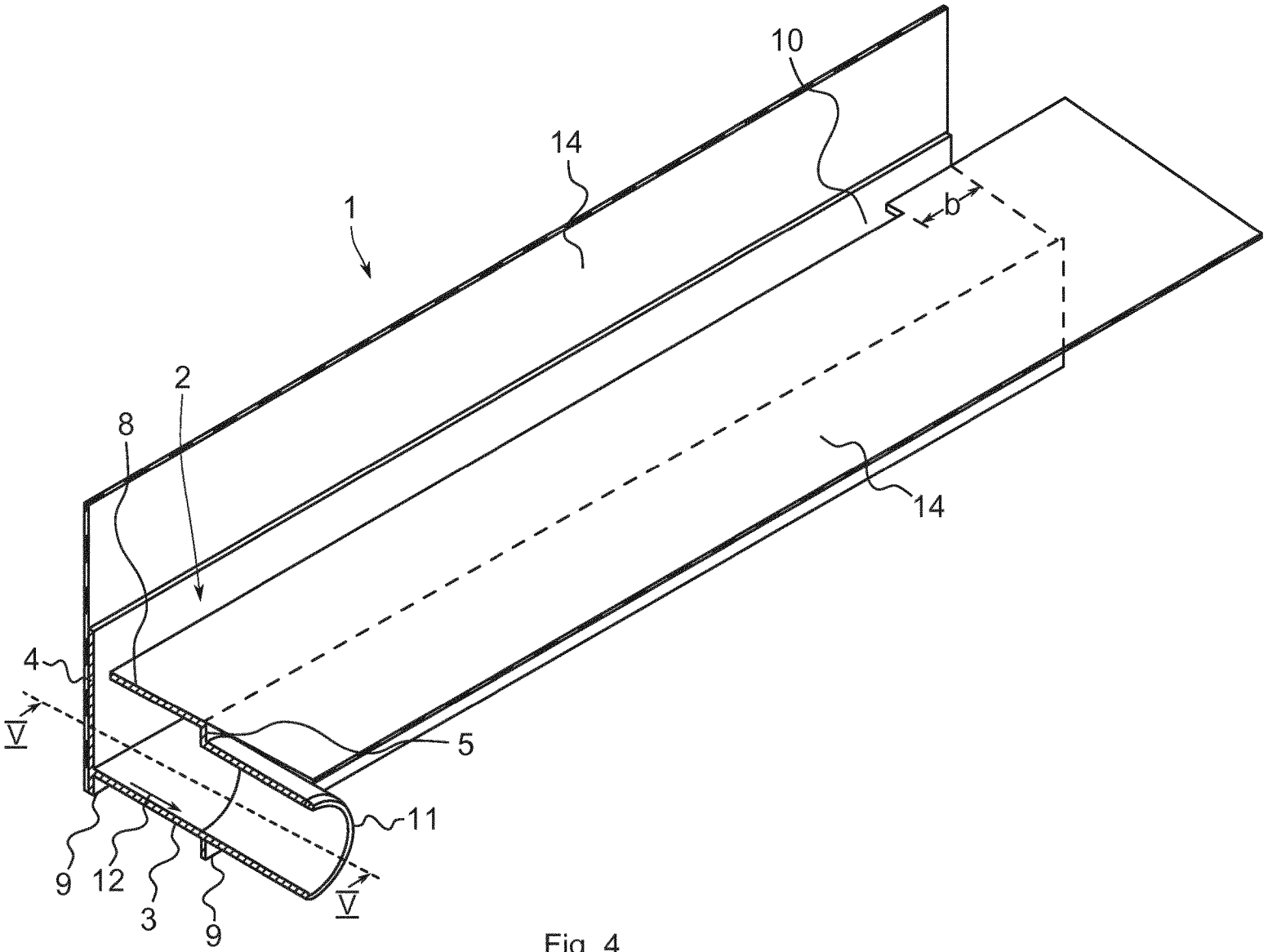
Figure 5:
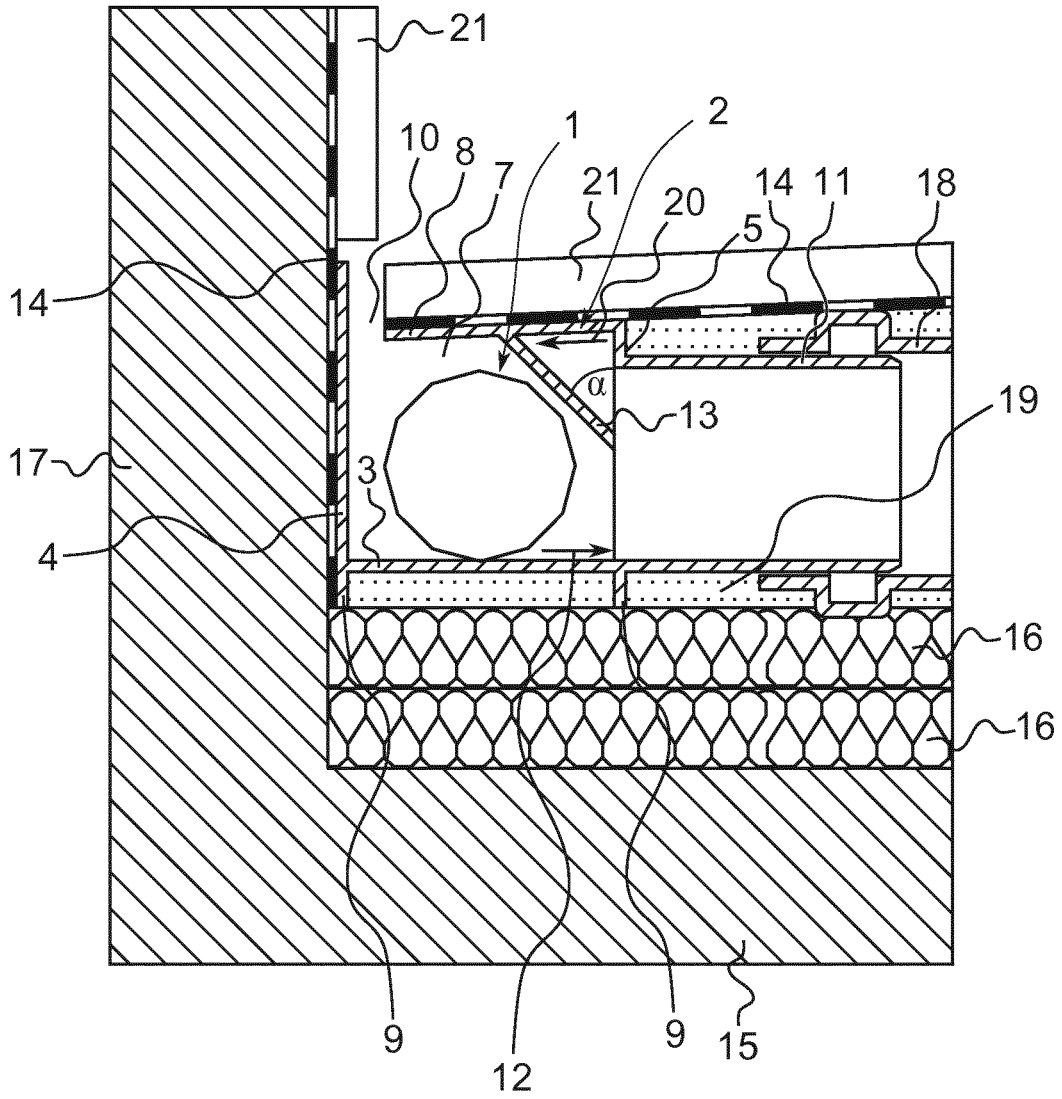
Figure 6:
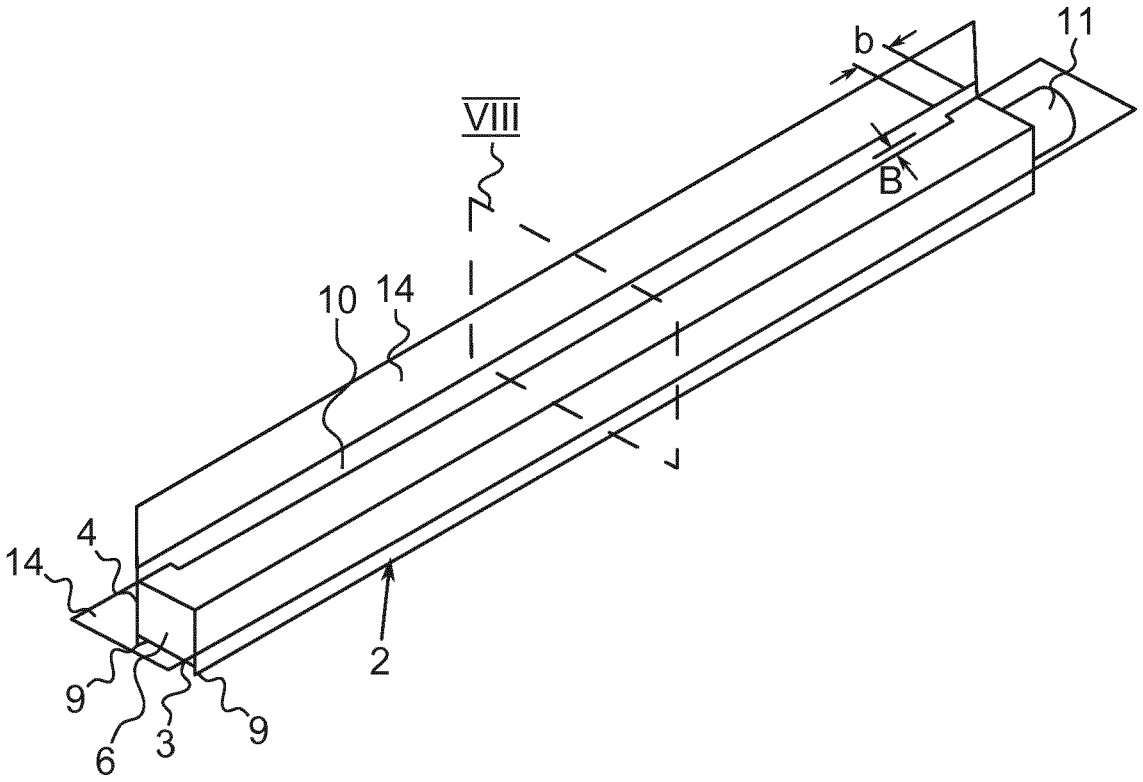
Figure 7:
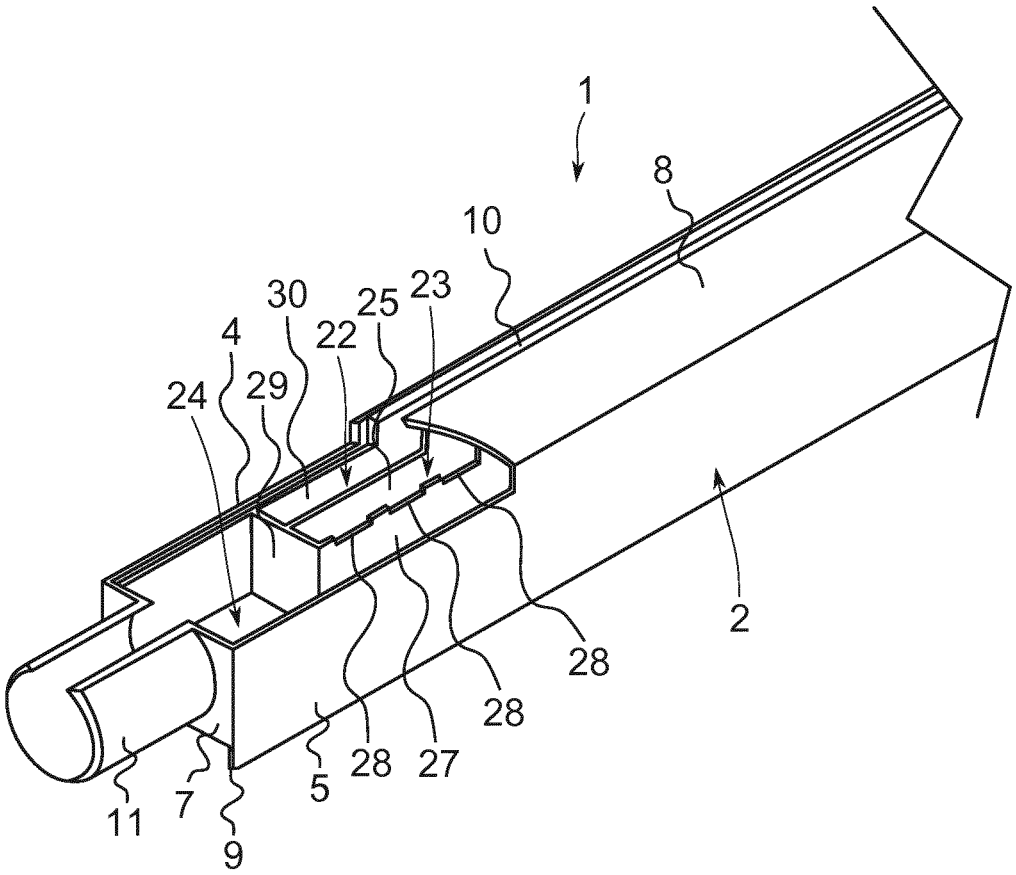
Figure 8:
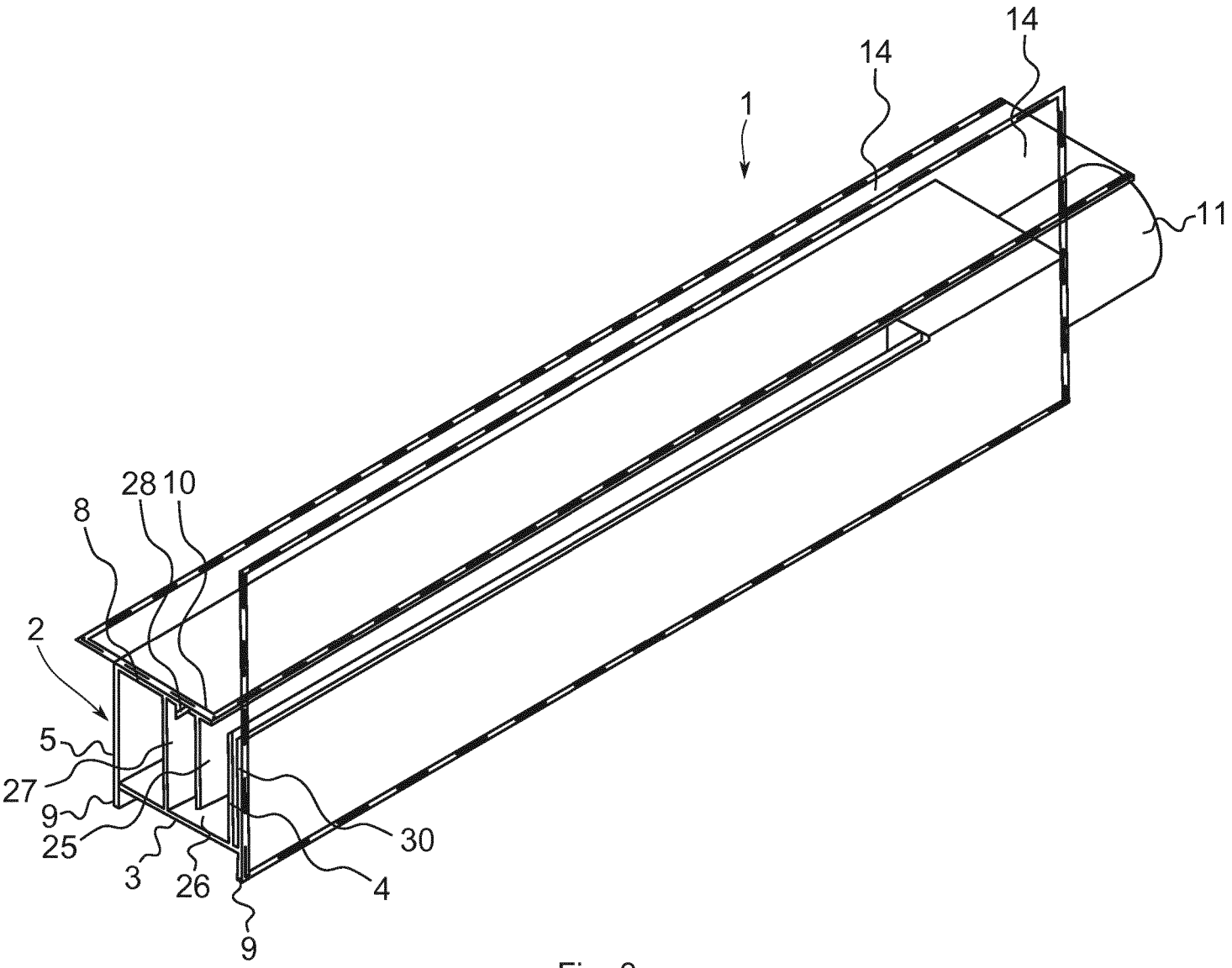
Figure 9:
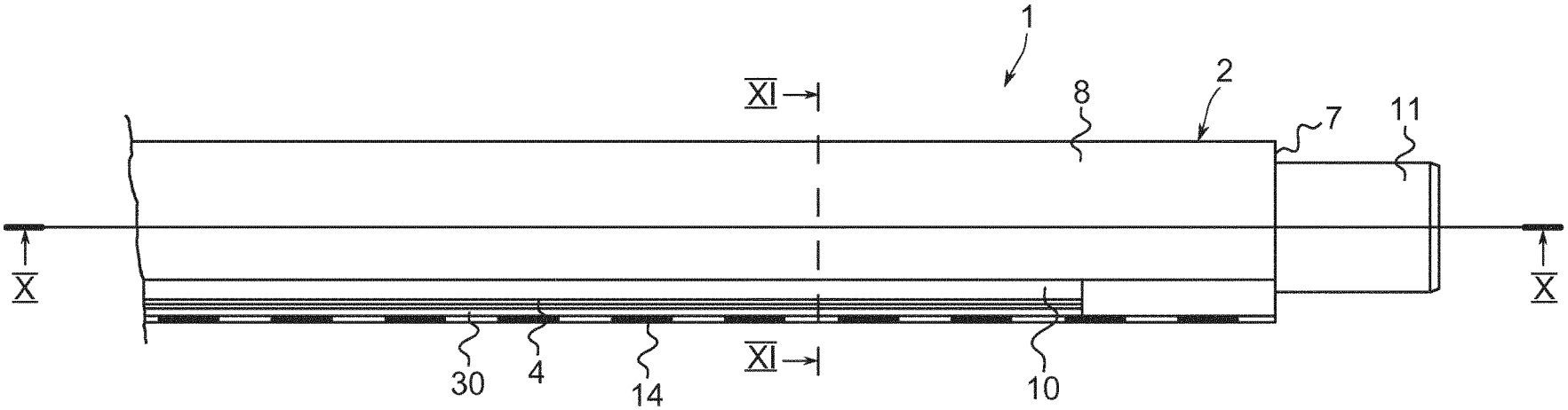
Figure 10:
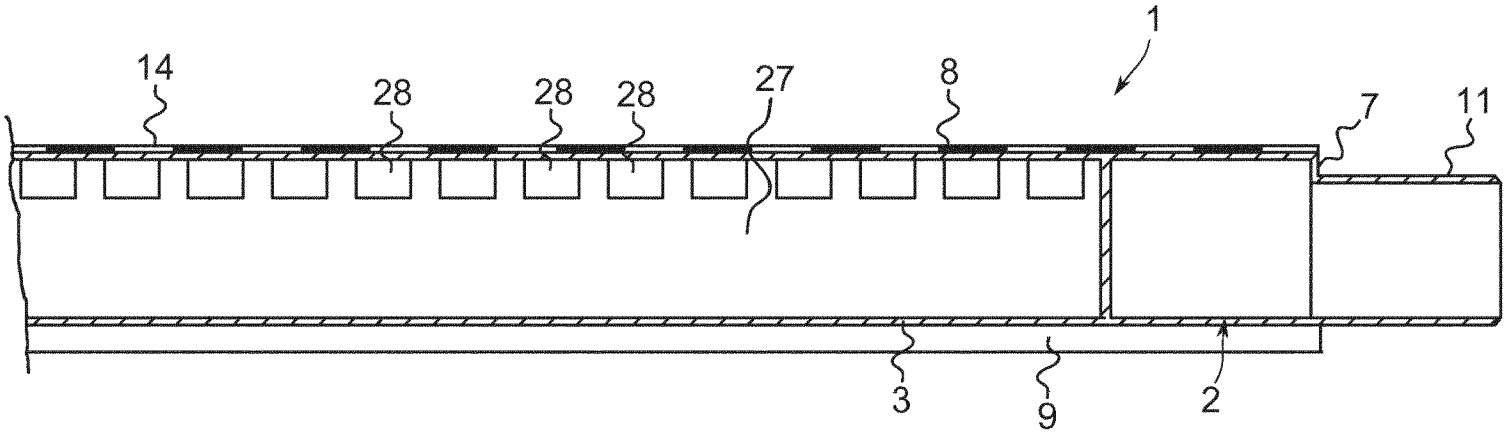
Figure 11:
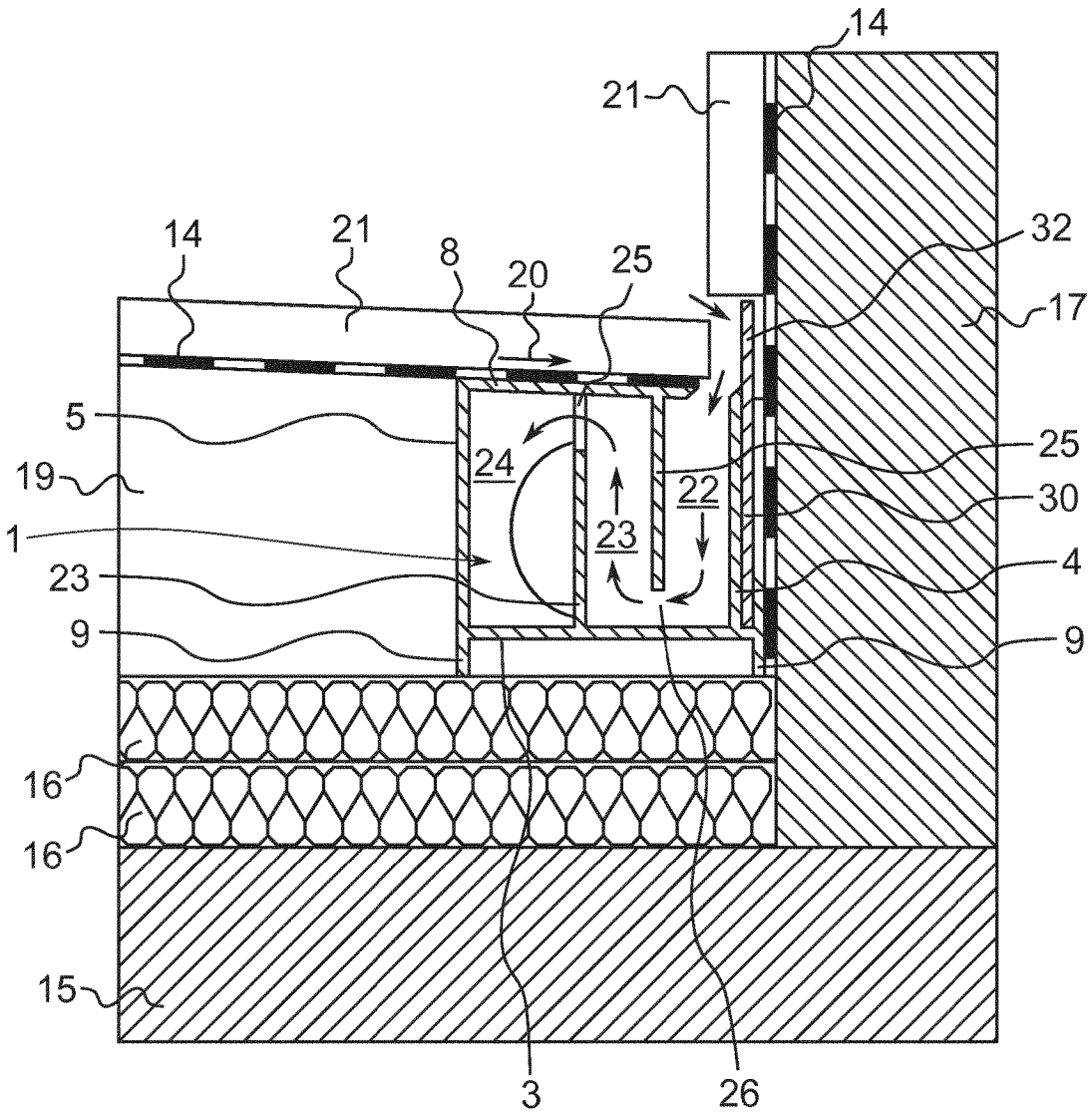
Figure 12:
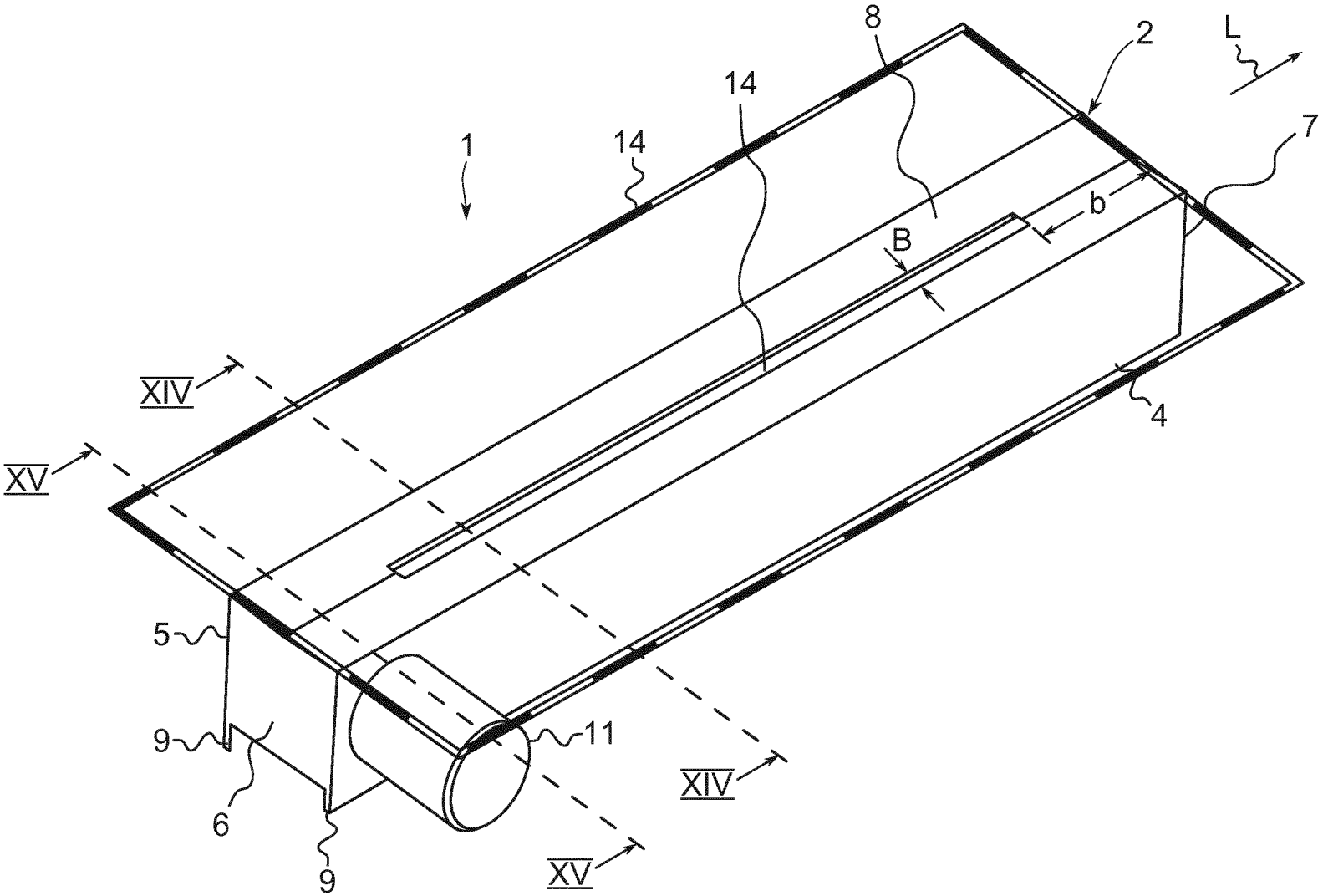
Figure 13:
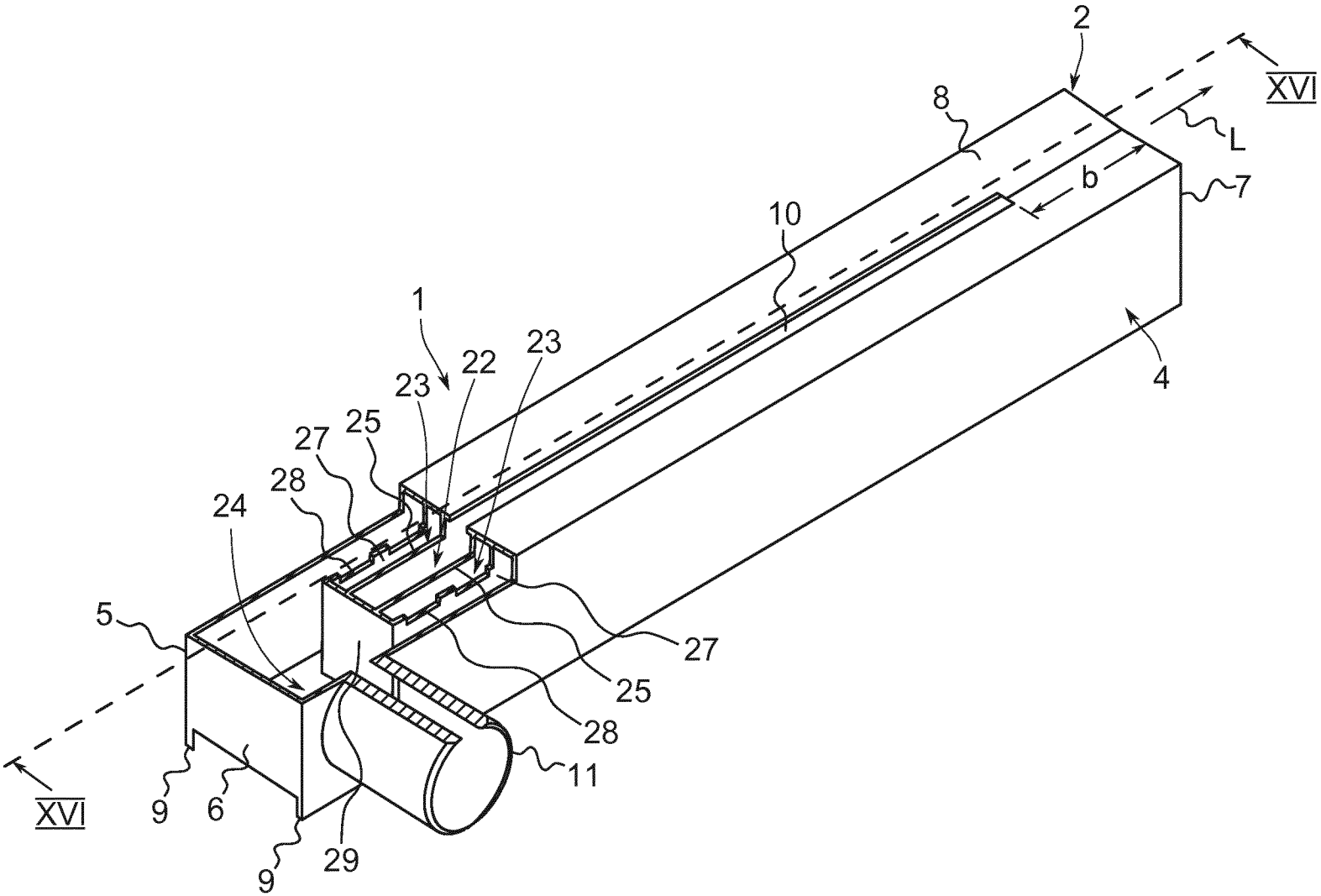
Figure 14:
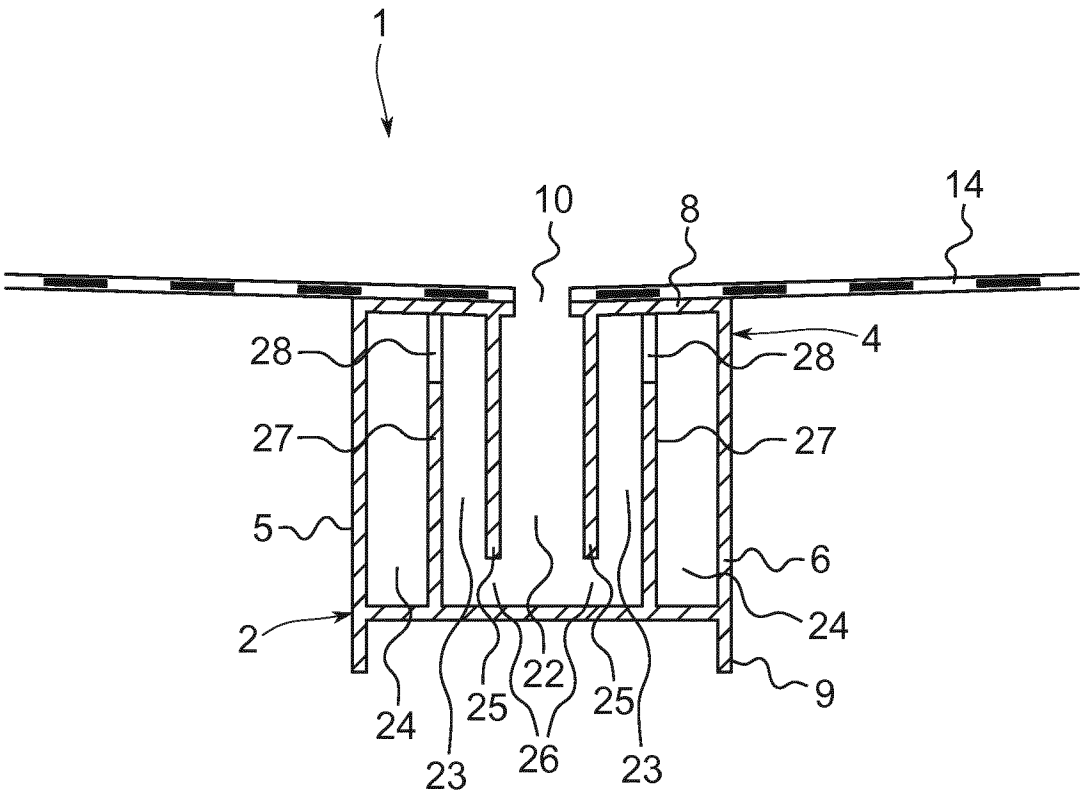
Figure 15:
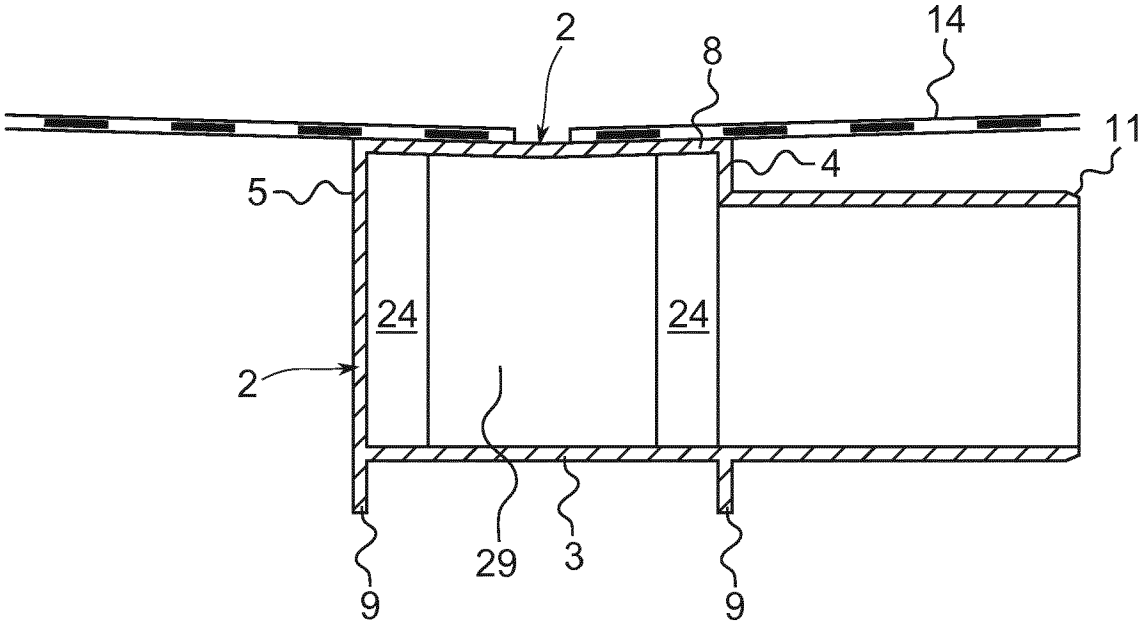
Figure 16:
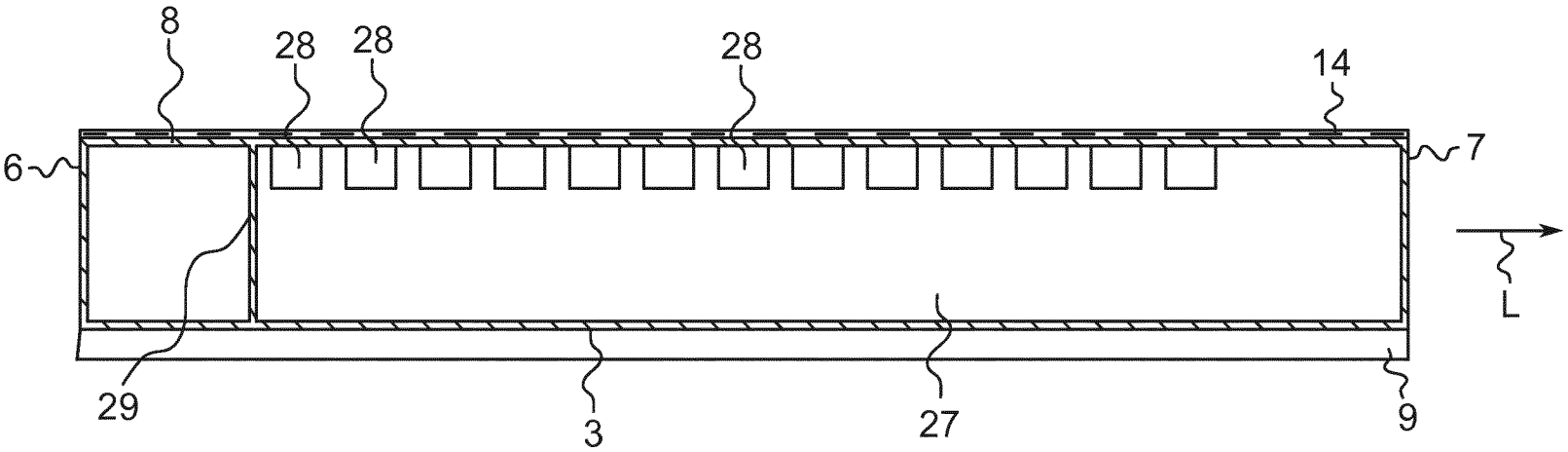
Figure 17:
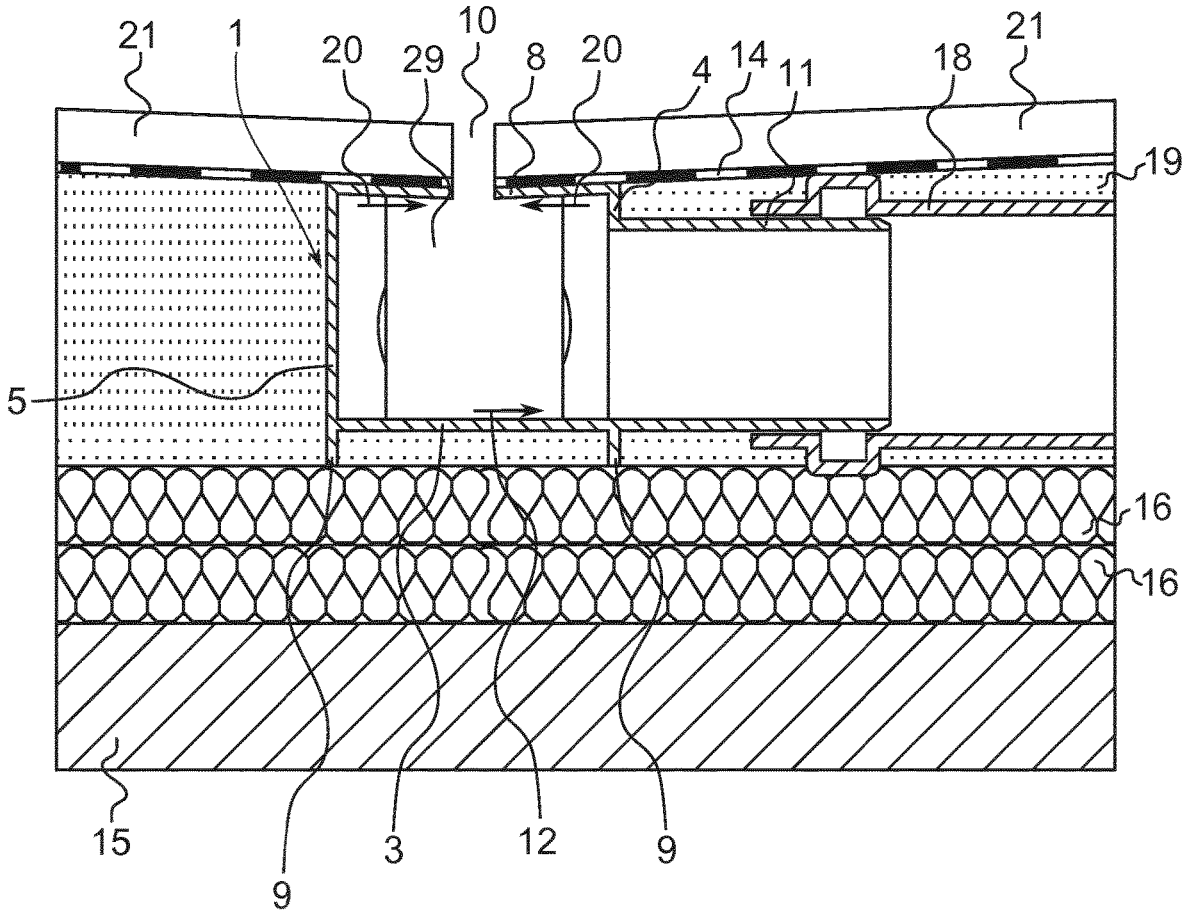

Further features and advantages of the present invention become clear from the following description of embodiments of floor drains according to the invention with reference to the attached drawings. These show as follows:

FIG. 1 a perspective view of a floor drain according to a first embodiment of the present invention, a sealing gasket of the floor drain being illustrated transparently;

FIG. 2 a top view of the floor drain illustrated in FIG. 1, a sealing gasket not being shown for the purpose of better illustration;

FIG. 3 a sectional view of the floor drain along line III-III in FIG. 2;

FIG. 4 a perspective sectional view of the floor drain along line IV-IV in FIG. 2;

FIG. 5 a sectional view of the floor drain along line V-V in FIG. 4, the floor drain being in the fitted state;

FIG. 6 a perspective view of a floor drain according to a second embodiment of the present invention, a sealing gasket of the floor draining being illustrated transparently;

FIG. 7 a partially sectioned perspective view of the floor drain illustrated in FIG. 6;

FIG. 8 a perspective sectional view of the floor drain along sectional plane VIII in FIG. 6;

FIG. 9 a top view of the floor drain illustrated in FIG. 6;

FIG. 10 a sectional view of the floor drain along line X-X in FIG. 9;

FIG. 11 a sectional view of the floor drain along line XI-XI in FIG. 9, the floor drain being in the fitted state;

FIG. 12 a perspective view of a floor drain according to a third embodiment of the present invention, a sealing gasket of the floor drain being illustrated transparently;

FIG. 13 a perspective, partially sectioned view of the floor drain shown in FIG. 12 without the sealing gasket;

FIG. 14 a sectional view of the floor drain along sectional plane XIV in FIG. 12;

FIG. 15 a sectional view of the floor drain along sectional plane XV in FIG. 12;

FIG. 16 a sectional view of the floor drain along sectional plane XVI in FIG. 13; and FIG. 17 a view of the floor drain similar to FIG. 15, the floor drain being in the fitted state.

FIGS. 1 to 4 show a floor drain 1 according to a first embodiment of the present invention, which is used, for example, in the installation of a level-access shower. The floor drain 1 comprises a one-part housing 2 which is elongate in form and which has a base wall 3, two side walls 4 and 5 extending in a longitudinal direction, two end walls 6 and 7 connecting the side walls 4 and 5 to one another, as well as a ceiling wall 8, the side wall 4 projecting upwards over the ceiling wall 8 by an amount a, preferably by 10 to 20 mm. The housing 2 is equipped with feet 9 which are in the form of an extension of the side walls 4 and 5. The ceiling wall 8 is provided with an inlet opening 10 which extends in the longitudinal direction L and in this case is rectangular in form, the ceiling wall 8 being slightly inclined downwards in the direction of the inlet opening, by means of which an incline is defined. The inlet opening 10 directly borders on the side wall 4 and ends in each case a distance b in front of the front-side ends of the ceiling wall 8, the distance b preferably being at least 10 mm, preferably more than 20 mm. The width B of the inlet opening 10 is in the range of from 4 to 12 mm. An outflow connection piece 11, which is used for the connection of a drain tube (not detailed), extends outwards from the side wall 5. Alternatively, the outflow connection piece 11 can also be positioned on one of the end walls 6 or 7, even though this is not the case here. The base wall 3 and a lower region of the inner wall of the outflow connection piece 11 merge smoothly into one another, the base wall 3 defining an incline falling away to the outflow connection piece 11 and which is indicated by the arrow 12. Supporting struts 13 extend within the housing 2 between the end wall 7 and the ceiling wall 8, in this case at an angle $\alpha$ of 45°. Attached to the outside of the ceiling wall 8 is a sealing gasket 14 which projects outwards by at least a few centimetres over the front-side ends of the ceiling wall 8 or over the side wall 5, is recessed in the region of the inlet opening 10 and, moreover, covers the entire ceiling wall 8. Another sealing gasket 14 is attached to the side wall 4 and projects upwards from the latter.

FIG. 5 shows the floor drain 1 illustrated in FIGS. 1 to 4 in the fitted stated as part of a level-access shower. In order to produce the arrangement shown in FIG. 5, in a first step insulating boards 16 are laid over a concrete floor 15. Next the floor drain 1 is positioned over the insulating boards 16 such that the sealing gasket 14 positioned on the side wall 14 comes to rest against a wall 17. The sealing gasket 14 is attached to the wall 17 here, for example using a tile adhesive. The rest of the wall is then sealed with sealing material. This sealing material may be sealing mats, the structure of which corresponds to that of the sealing gaskets 14. Alternatively however, one can also use a spreadable sealing compound, to give just one example. In a further step, a drain tube 18 is connected to the outflow connection piece 11, which drain tube forms part of a domestic sewage system. A screed 19 is then applied to the upper side of the insulating boards 16 so that the screed 19 ends flush with the ceiling wall 8 of the housing 2 and defines an incline falling away in the direction of the inlet opening 10, which incline is indicated by the arrow 20 and preferably corresponds to the incline defined by the ceiling wall 8. Instead of the screed 19 one may basically also use a pre-fabricated incline element, such as for example an inclined board or the like. After the screed 19 has set, the lower side of the protruding region of the sealing gasket 14 held against the ceiling wall 8 is attached to the upper side of the screed 19, and this can in turn take place using a tile adhesive. The entire upper side of the screed 19 is then sealed with an appropriate sealing material. The same applies to the cross-overs between the upper side of the sealing gasket 14 held against the ceiling wall 8 and the upper side of the screed. For this purpose, appropriate sealing mats or spreadable sealing compound can once again be used. Sealing mats should be laid such that they overlap the sealing gasket 14 fixed to the screed 19 from above. Alternatively, the sealing gasket 14 may basically also have dimensions such that it covers the entire base area of the shower and the use of additional sealing mats or any additional seal becomes unnecessary. In a final step tiles 21 are laid over the base and the walls using a tile adhesive.

The arrangement illustrated in FIG. 5 is particularly advantageous in that, by virtue of the fact that the inlet opening 10 is enclosed by the sealing gasket 14 on the front side, a good seal can be established between the floor drain 1 and the surrounding screed without any problem. If one of the front sides 6 or 7 borders a room wall, the sealing gasket 14 protruding on the front-side can be raised on the room wall. Another advantage is that the incline indicated by the arrow 20 must only have a single direction, in the direction of the inlet opening, because the inlet opening 10 borders directly on the wall 17. Furthermore, the water outflow defined by the floor drain 1 and the tiles 21 is barely visible. Despite the very inexpensive structure of the floor drain 1, this provides a novel and optically very attractive appearance.

FIGS. 6 to 11 show a floor drain 1 according to a second embodiment of the present invention, the structure of which largely corresponds to that of the previously described floor drain, and this is why functionally identical components are identified with the same reference numbers and are not explained again. The floor drain 1 differs from the previously described floor drain on the one hand in that the outflow connection piece 11 is positioned on the end wall 7. Furthermore, an odour trap is integrated into the housing 2 which in this case has two accumulation chambers 22 and 23, which fill with accumulated water in the correct state of the floor drain 1, and an outflow chamber 24, the first accumulation chamber 22 and the second accumulation chamber 23 being separated from one another by a first partition wall 25 extending in the longitudinal direction L and downwards from the ceiling wall 8, which first partition wall 25 is provided in the lower region with one or with a number of first through holes 26, and the second accumulation chamber 23 and the outflow chamber 24 being separated from one another by a second partition wall 27 extending in the longitudinal direction L and upwards from the base wall 3, which second partition wall is provided in the upper region with a number of second through holes 28. Due to the fact that the second partition wall 27 extends partially continuously between the base wall 3 and the ceiling wall 8, it acts as a support for the ceiling wall 8, for which reason no additional supporting strut 13 is required. The second accumulation chamber 23 alone is fluidically connected via the second through holes 28 to the outflow connection piece 11, which in this case is realised by an additional partition wall 29 which closes the accumulation chambers 22 and 23 on the front side pointing towards the outflow connection piece 11. The housing 2 also has at least one upwardly extending bar 30 which is positioned adjacent to the inside of the side wall 4, on which the inlet opening 10 borders, the side wall 4 and the bar 30 defining between them a receiving slot 31 into which an elongate screen 32 in the form of a strip is inserted, which can be inserted into the receiving slot 31 and the protrusion of which over the ceiling wall 8 can be varied by appropriately choosing the insertion depth. Therefore, the screen 32 forms an alternative to the higher side wall 4 of the previously described floor drain 1, the screen 32 being advantageous in that it can be handled more flexibly when fitting the floor drain 1.

FIGS. 12 to 17 show a floor drain 1 according to a third embodiment of the present invention, the structure of which corresponds largely to that of the previously described second embodiment, and this is why functionally identical components are identified with the same reference numbers and are not explained again. The floor drain 1 of the third embodiment differs from that of the second embodiment on the one hand in that the outflow connection piece 11 is positioned in an end region of the side wall 5. Furthermore, the inlet opening 10 is positioned centrally and equidistantly from the side walls 4 and 5. The odour trap comprises a centrally positioned first accumulation chamber 22 and two second accumulation chambers 23 which are each positioned adjacent to the first accumulation chamber 22 and are connected fluidically to the common outflow chamber 24. Furthermore, only a single sealing gasket 14 is provided which is positioned on the upper side of the ceiling wall 8, recesses the inlet opening 10 and projects outwardly over both side walls 4 and 5 and over both front-side ends of the ceiling wall 8. The floor drain 1 according to the third embodiment of the present invention is in particular intended to be positioned a distance away from a room wall during its installation.

Moreover, it should be pointed out that the floor drains according to the second and the third embodiment can also be designed without an odour trap.

Although the invention has been illustrated and described in more detail by the preferred exemplary embodiment, the invention is not restricted by the disclosed examples, and other variations can be derived from this by the person skilled in the art without straying from the scope of protection of the invention.

LIST OF REFERENCE SIGNS

1 floor drain
2 housing
3 base wall
4 side wall
5 side wall
6 end wall
7 end wall
8 ceiling wall
9 foot
10 inlet opening
11 outflow connection piece
12 arrow
13 supporting strut
14 sealing gasket
15 concrete floor
16 insulating board
17 wall
18 drain tube
19 screed
20 arrow
21 tile
22 accumulation chamber
23 accumulation chamber
24 outflow chamber
25 partition wall
26 through hole
27 partition wall
28 through hole
29 partition wall
30 bar
31 receiving slot
32 screen a distance
b distance
B width
α angle

The invention claimed is:

1. A floor drain (1) comprising:

an elongate housing (2) having a base wall (3), two side walls (4, 5) extending in a longitudinal direction, two end walls (6, 7) connecting the side walls (4, 5) to one another, and a ceiling wall (8) provided with an elongate inlet opening (10) extending in the longitudinal direction (L), and an outflow connection piece (11) extending outwardly from the base wall (3) or from one of the side walls (4, 5) or from one of the end walls (6, 7) for the connection of a drain tube, wherein the inlet opening (10) terminates in each case a distance away from the front-side ends of the ceiling wall (8) and a distance away from at least one of the side walls (4, 5) so that a receiving flange surrounding the inlet opening (10) is formed, the receiving flange being attachable to a sealing gasket 14);

wherein the ceiling wall (8) defines at least one incline falling away in the direction of the inlet opening (10), or that the base wall (3) defines an incline falling away towards the outflow connection piece (11).

2. The floor drain (1) according to claim 1, wherein the inlet opening (10) is positioned a distance (b) away from the front-side ends of the ceiling wall (8), which distance is at least 10 mm and/or that the inlet opening (10) has a width (B) in the range of from 4 to 12 mm.

3. The floor drain (1) according to claim 1, wherein the sealing gasket (14) is attached to the ceiling wall (8) and the sealing gasket (14) projects over the front-side and/or side ends of the ceiling wall (8).

4. The floor drain (1) according to claim 1, wherein the base wall (3) and a lower region of the inner wall of the outflow connection piece (11) merge into one another.

5. The floor drain (1) according to claim 1, further comprising at least one supporting strut (13) extending in the longitudinal direction between a side wall (5) and the ceiling wall (8) or between the base wall (3) and the ceiling wall (8).

6. The floor drain (1) according to claim 1, wherein the housing (2) includes feet (9) extending to the side walls (4, 5) or the front walls (6, 7).

7. The floor drain (1) according to claim 1, wherein the inlet opening (10) borders directly on one of the side walls (4).

8. The floor drain (1) according to claim 1, wherein the sealing gasket (14) projects upwards from the side wall (4) and is attached to one of the side walls (4).

9. The floor drain (1) according to claim 8, wherein the housing (2) has at least one upwardly extending bar (30) positioned adjacent to the inside of the side wall (4) on which the inlet opening (10) directly borders and extends from the base wall (3) or the side wall (4), the side wall (4) and the at least one bar (30) defining between them a receiving slot (31), and an elongate, strip-shaped screen (32) being insertable into the receiving slot (31) and the protrusion of which over the ceiling wall (8) is varied by the corresponding choice of insertion depth, the at least one bar (30) extending at least over the entire length of the inlet opening (10).

10. The floor drain (1) according to claim 1, wherein the housing (2) is made in one part or is made up of individual components connected to one another undetachably.

11. The floor drain (1) according to claim 1, further comprising an odour trap formed within the housing (2) which fluidically connects the inlet opening (10) to the outflow connection piece (11), the odour trap having at least two accumulation chambers (22, 23) which, in the correct state of the floor drain (11), fill with accumulated water, and an outflow chamber (24), the first accumulation chamber (22) and the second accumulation chamber (23) being separated from one another by a first partition wall (25) extending in the longitudinal direction (L) and downwards from the ceiling wall (8), said first partition wall being provided in the lower region with one or with a number of first through holes (26), and the second accumulation chamber (23) and the outflow chamber (24) being separated from one another by a second partition wall (27) extending in the longitudinal direction (L) and upwards from the base wall (3), said second partition wall being provided in the upper region with one or with a number of second through holes (28), and/or the accumulation chambers (22, 23) being closed on at least one of their front sides by an additional partition wall (29).

12. The floor drain according to claim 11, wherein the inlet opening (10) is positioned centrally and equidistantly from the side walls (4, 5), and wherein the odour trap has a first accumulation chamber (22) positioned centrally and two second accumulation chambers (23) each positioned adjacent to the first accumulation chamber (22) and connected fluidically to a common outflow chamber (24), or that the height of the first and the second through holes (26, 28) is between 4 and 12 mm, or that the odour trap and the housing (2) are made in one part or are connected undetachably to one another.

13. The floor drain (1) according to claim 7, wherein the housing (2) has at least one upwardly extending bar (30) positioned adjacent to the inside of the side wall (4) on which the inlet opening (10) directly borders and extends from the base wall (3) or the side wall (4), the side wall (4) and the at least one bar (30) defining between them a receiving slot (31), and an elongate, strip-shaped screen (32) insertable into the receiving slot (31) and the protrusion of which over the ceiling wall (8) is varied by the corresponding choice of insertion depth, the at least one bar (30) extending at least over the entire length of the inlet opening (10).

14. A floor drain (1) comprising:

an elongate housing (2) having a base wall (3), two side walls (4, 5) extending in a longitudinal direction, two end walls (6, 7) connecting the side walls (4, 5) to one another, and a ceiling wall (8) provided with an elongate inlet opening (10) extending in the longitudinal direction (L), and an outflow connection piece (11) extending outwardly from the base wall (3) or from one of the side walls (4, 5) or from one of the end walls (6, 7) for the connection of a drain tube, wherein the inlet opening (10) terminates in each case a distance away from the front-side ends of the ceiling wall (8) and a distance away from at least one of the side walls (4, 5) so that a receiving flange surrounding the inlet opening (10) is formed, the receiving flange being attachable to a sealing gasket 14);

wherein the base wall (3) and a lower region of the inner wall of the outflow connection piece (11) merge into one another.

15. A floor drain (1) comprising:

an elongate housing (2) having a base wall (3), two side walls (4, 5) extending in a longitudinal direction, two end walls (6, 7) connecting the side walls (4, 5) to one another, and a ceiling wall (8) provided with an elongate inlet opening (10) extending in the longitudinal direction (L), and an outflow connection piece (11) extending outwardly from the base wall (3) or from one of the side walls (4, 5) or from one of the end walls (6, 7) for the connection of a drain tube, wherein the inlet opening (10) terminates in each case a distance away from the front-side ends of the ceiling wall (8) and a distance away from at least one of the side walls (4, 5) so that a receiving flange surrounding the inlet opening (10) is formed, the receiving flange being attachable to a sealing gasket 14); and wherein the housing (2) includes feet (9) extending to the side walls (4, 5) or the front walls (6, 7).

* * * * *